US008414311B2

(12) United States Patent
Ju

(10) Patent No.: US 8,414,311 B2
(45) Date of Patent: Apr. 9, 2013

(54) SOCKET TERMINAL FOR GRID ARRAY CONNECTOR

(75) Inventor: Ted Ju, Keelung (TW)

(73) Assignee: Lotes Co., Ltd, Keelung (TW)

( * ) Notice: Subject to any disclaimer, the term of this patent is extended or adjusted under 35 U.S.C. 154(b) by 289 days.

(21) Appl. No.: 13/042,820

(22) Filed: Mar. 8, 2011

(65) Prior Publication Data

US 2012/0156939 A1 Jun. 21, 2012

(30) Foreign Application Priority Data

Dec. 20, 2010 (CN) ..... 2010 2 0671332 U

(51) Int. Cl.
*H01R 12/00* (2006.01)

(52) U.S. Cl. ..... 439/83

(58) Field of Classification Search ..... 439/83, 439/342, 65, 857; *H01R 12/57*
See application file for complete search history.

(56) References Cited

U.S. PATENT DOCUMENTS

| | | | | |
|---|---|---|---|---|
| 6,533,590 | B1 * | 3/2003 | Lee et al. | 439/83 |
| 8,147,256 | B2 * | 4/2012 | Jin | 439/83 |
| 2006/0258191 | A1 * | 11/2006 | Chen | 439/83 |
| 2009/0088016 | A1 * | 4/2009 | Liao | 439/357 |

* cited by examiner

*Primary Examiner* — Vanessa Girardi
(74) *Attorney, Agent, or Firm* — Morris Manning & Martin LLP; Tim Tingkang Xia, Esq

(57) ABSTRACT

An electrical connector that includes: an insulating body, having a plurality of receiving slots running through the insulating body, a plurality of terminals, respectively received in the receiving slots, in which the terminal has a base fixed in the receiving slot, two first abutting segments extending downwards from the base, two second abutting segments extending forwards the two first abutting segments, the two second abutting segments are exposed from the receiving slot and abut against the bottom surface of the insulating body, the width between the two second abutting segments is smaller than the diameter of a solder ball, a plurality of stop blocks, respectively disposed in the receiving slots, and a plurality of solder balls, respectively received in the receiving slots.

13 Claims, 12 Drawing Sheets

SOCKET TERMINAL FOR GRID ARRAY CONNECTOR

CROSS-REFERENCE TO RELATED APPLICATIONS

This non-provisional application claims priority under 35 U.S.C. §119(a) on Patent Application No. 201020671332.X filed in The People's Republic of China on Dec. 20, 2010, the entire contents of which are hereby incorporated by reference.

FIELD OF THE INVENTION

The present invention relates to an electrical connector, and more particularly to an electrical connector for electrically connecting a chip module to a circuit board.

BACKGROUND OF THE INVENTION

FIGS. 1 and 2 show an electrical connector currently widely used in the filed for electrically connecting a chip module to a circuit board. The electrical connector includes: an insulating body 502, having a plurality of receiving slots 5021, a plurality of conductive terminals 504, received in the receiving slots 5021 respectively, and a plurality of solder balls 506, connected to the conductive terminals 504 respectively. The conductive terminal 504 is formed by punching a metal sheet and has a main portion 5041, two first abutting segments 5042 extending downwards from the main portion 5041, and two second abutting segments 5043 extending forwards from the two first abutting segments 5042. The two second abutting segments 5043 do not abut against a bottom surface of the insulating body 502. The two second abutting segments 5043 are used for retaining the solder ball 506.

The main portion 5041 is first extended downwards to form the two first abutting segments 5042. Then the two first abutting segments 5042 are extended forwards to form the two second abutting segments 5043. Therefore, the expanded area of the conductive terminal 504 is reduced, thereby saving the material. However, when the solder ball 506 is riveted upwards between the two second abutting segments 5043, the solder ball 506 generates an upward push force on the two second abutting segments 5043. As the two second abutting segments 5043 do not abut against the bottom surface of the insulating body 502, the two second abutting segments 5043 undergo upward deformation without a support. When the push force exceeds a set range value, the two second abutting segments 5043 are broken or in permanent deformation, thereby influencing the life of the conductive terminal 504.

FIGS. 3 and 4 illustrate an electrical connector that includes: an insulating body 602, having a plurality of receiving slots 6021, a plurality of conductive terminals 604, received in the receiving slots 6021 respectively, and a plurality of solder balls (not shown), connected to the conductive terminals 604 respectively. The conductive terminal 604 is formed by punching the metal sheet and has a base 6041, a material belt connecting portion 6042 extending downwards from the base 6041, and two retaining arms 6043 bending and extending forwards from two sides of the material belt connecting portion 6042. The two retaining arms 6043 are exposed from the receiving slots 6021 and abut against a bottom surface of the insulating body 602 so as to limit an excessively upward movement thereof. The two retaining arms 6043 are in the shape of a circle and used for encircling a horizontal center line of the solder ball. The insulating body 602 or the conductive terminal 604 does not have a structure used for stopping the solder ball from moving upwards.

The two retaining arms 6043 are exposed from the receiving slots 6021 and abut against the bottom surface of the insulating body 602. When the solder ball is disposed upwards between the retaining arms, the retaining arms 6043 are incapable of excessively moving upwards with the bottom surface of the insulating body 602 as a support, thereby effectively protecting the conductive terminal 604 and ensuring the life of the conductive terminal 604. However, the following defects still exist.

1. The base 6041 is extended downwards to form a material belt connecting portion 6042. Two sides of the material belt connecting portion 6042 are bent and extended forwards to form the two retaining arms 6043. The design leads to a large expanded area of the conductive terminal 604, thereby generating a great deal of waste materials at the time of stamping and cutting the conductive terminal 604 on the metal sheet.

2. The insulating body 602 or the conductive terminal 604 does not have a structure for stopping the solder ball from moving upwards. When the solder ball is riveted and pressed between the two retaining arms 6043, it is impossible to precisely ensure that the solder ball is retained at the horizontal center line thereof by the two retaining arms 6043. Therefore, the solder balls are uneven so that the solder balls higher than the other solder balls relative to the circuit board, cannot be soldered during the soldering, further influencing electrical conduction between the electrical connector and the circuit board.

3. During the soldering, since the two retaining arms 6043 encircles the horizontal center line of the solder ball, the melted solder paste cannot basically fall on the surface of the retaining arms 6043. It is more likely to fall on the circuit board, thereby causing an occurrence in which the conductive terminal 604 cannot be soldered firmly with the circuit board, or problems such as missing solder or false soldering, and further influencing the electrical conduction between the electrical connector and the circuit board.

Therefore, a heretofore unaddressed need exists in the art to address the aforementioned deficiencies and inadequacies.

SUMMARY OF THE PRESENT INVENTION

In one aspect, the present invention is directed to an electrical connector which cannot only save the material and prevent a terminal from excessively moving upwards, but also enable solder balls to locate at the same height relative to a circuit board and balance solder paste on the terminal and the circuit board so as to ensure the soldering effect.

In one embodiment, the present invention has the following inventive measures and provides an electrical connector that includes: an insulating body, having a plurality of receiving slots formed through the insulating body, in which each of the receiving slots has a stop block disposed on an inner side wall thereof, a plurality of terminals, received in the receiving slots respectively, in which the terminal has a base fixed in the receiving slot, two first abutting segments extending downwards from the base, two second abutting segments extending forwards from the two first abutting segments, the two second abutting segments are exposed from the receiving slot and abut against a bottom surface of the insulating body so as to limit the upward movement thereof, a width between the two second abutting segments is smaller than a diameter of a solder ball, and a plurality of solder balls, received in the receiving slots respectively, in which the two abutting segments are located on the periphery below the horizontal center line of the solder ball, and the solder ball is located below the bottom surface of the stop block in the receiving slot therein so as to limit the upward movement thereof.

Compared with the related art, among other things, the electrical connector of the present invention has the following advantages.

1. The base is extended downwards to form the two first abutting segments. The two first abutting segments are extended forwards to form the two second abutting segments. The expanded area of the terminal is reduced, thereby saving the material.

2. The two second abutting segments are exposed from the receiving slot and abut against the bottom surface of the insulating body. When the solder ball is riveted and pressed between the two second abutting segments, the two second abutting segments cannot excessively move upwards with the bottom surface of the insulating body as a support, thereby effectively protecting the terminal and ensuring the life of the terminal.

3. The stop block is disposed in the receiving slot of the insulating body and abuts against the solder ball. When the solder ball is riveted and pressed between the two second abutting segments, the two second abutting segments support the solder ball on a pre-determined position and the solder ball is located at the same height as other solder balls relative to the circuit board, thereby ensuring the soldering between the electrical connector and the circuit board and further ensuring the electrical conduction between the electrical connector and the circuit board.

4. During the soldering, since the two second abutting segments are located on the periphery below the horizontal center line of the solder ball, the melted solder paste falls partially on the surface of the second abutting segments as a result of the stop of the second abutting segments, which can slow down the speed of the solder paste flowing to the circuit board and relatively balance the solder paste on the terminal and the circuit board, thereby ensuring the soldering effect between the terminal and the circuit board, further ensuring the electrical conduction between the electrical connector and the circuit board and meanwhile avoiding problems such as missing solder or false soldering.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The drawings described below are for illustration purpose only. The drawings are not intended to limit the scope of the present teachings in any way.

DETAILED DESCRIPTION OF THE PRESENT INVENTION

Figure 1:
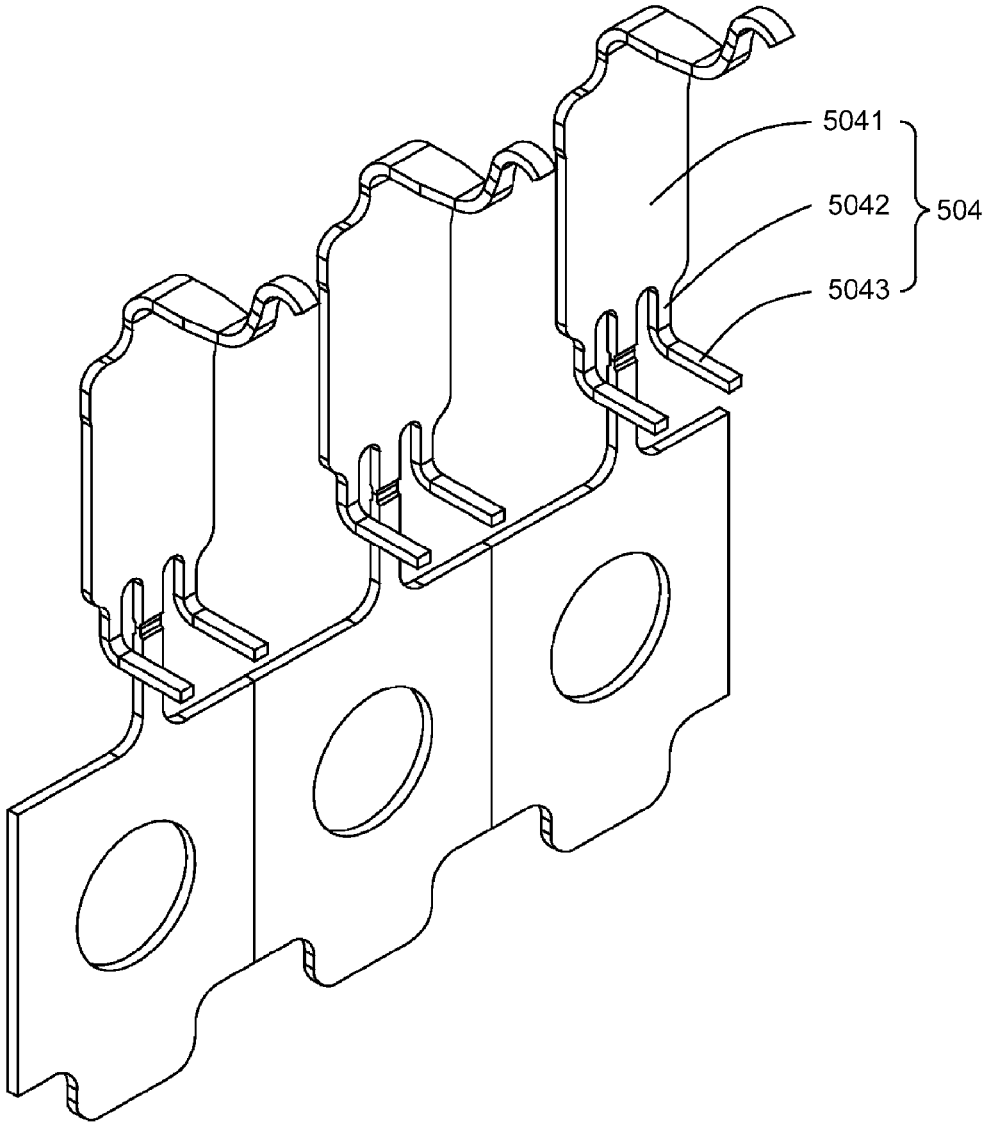
FIG. 1 (Related Art)
FIG. 1 is a schematic view of a conductive terminal in an electrical connector in a related art.
Figure 2:
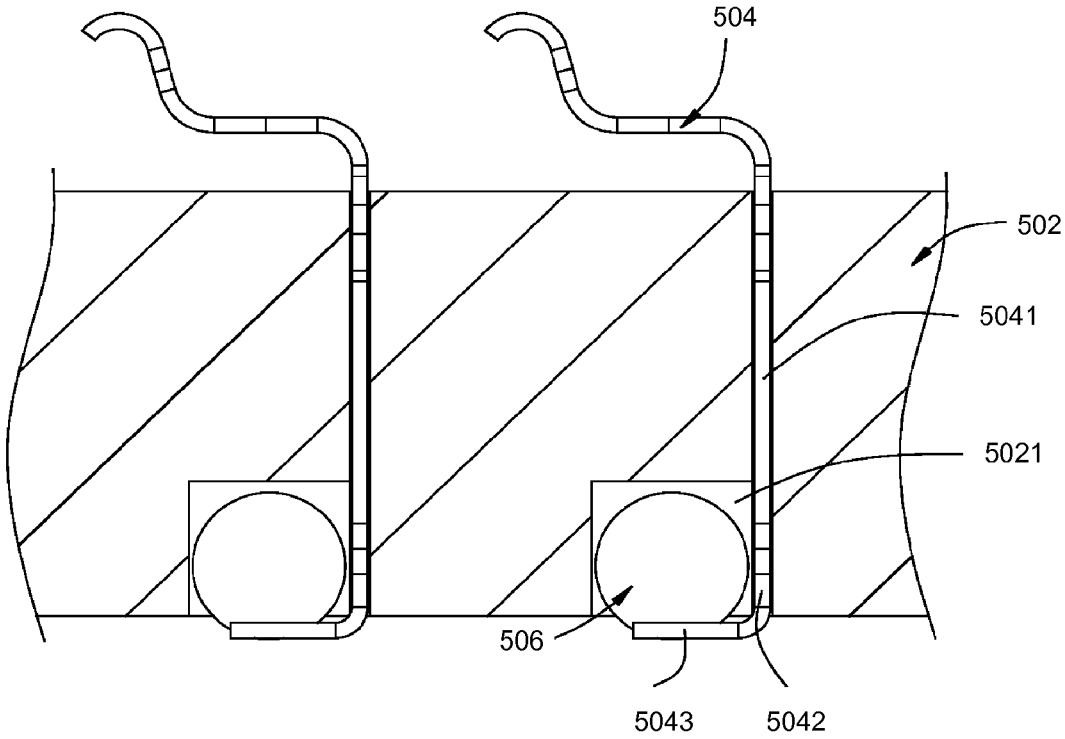
FIG. 2 (Related Art)
FIG. 2 is a sectional view of the electrical connector in FIG. 1.
Figure 3:
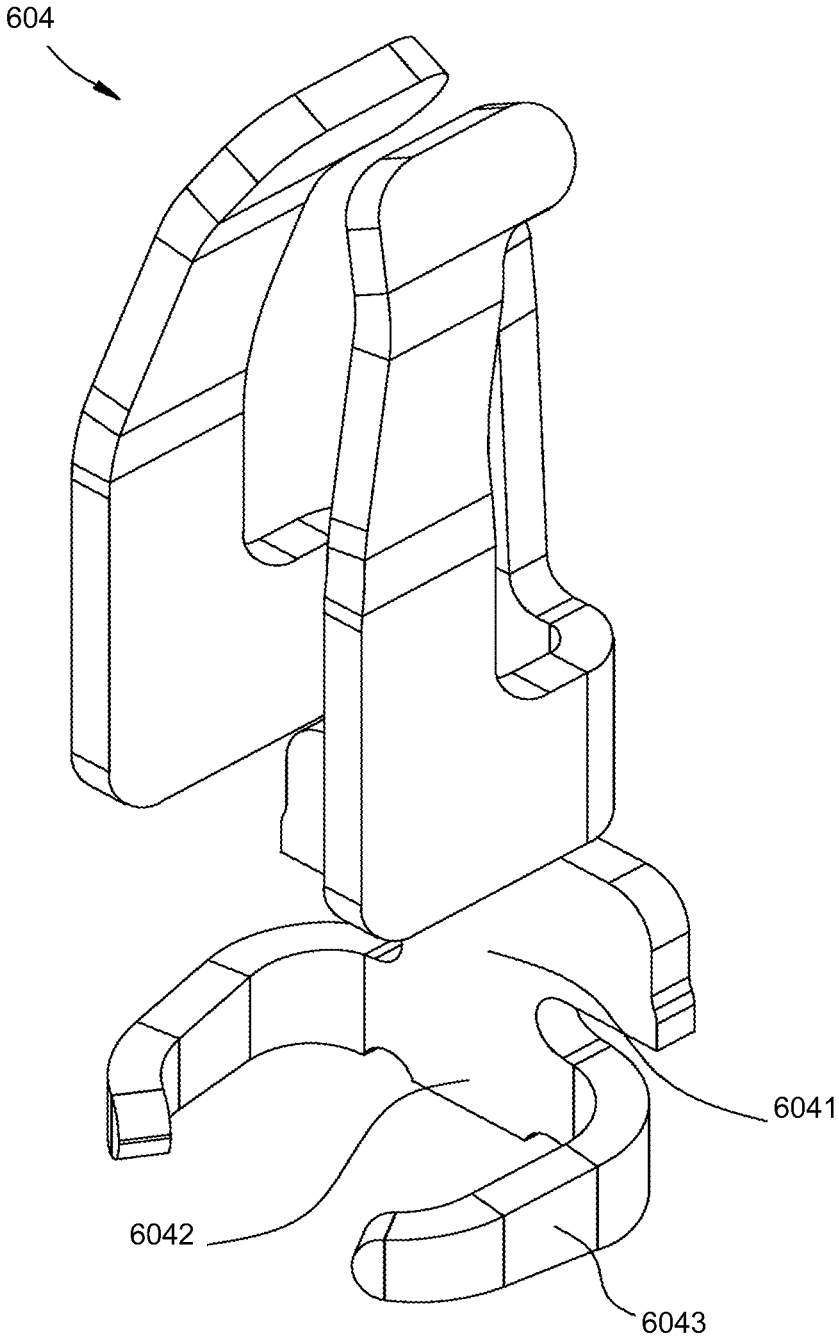
FIG. 3 (Related Art)
FIG. 3 is a schematic view of a conductive terminal in an electrical connector in another related art.
Figure 4:
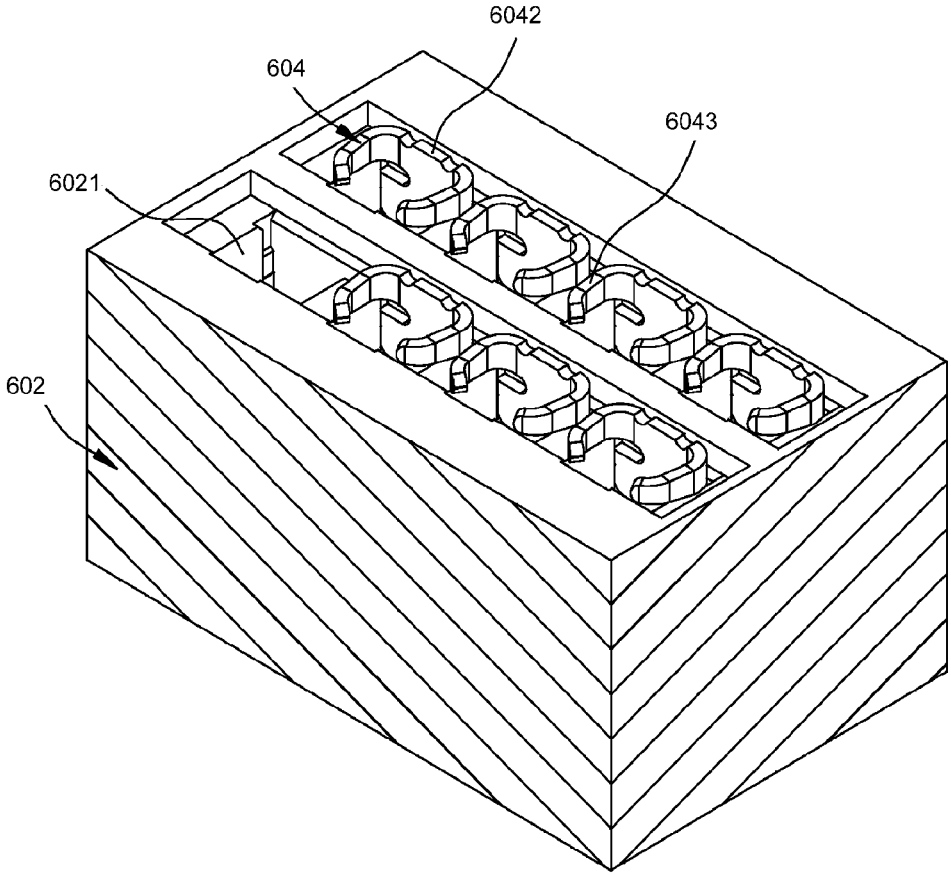
FIG. 4 (Related Art)
FIG. 4 is a constitutional view of the electrical connector in FIG. 3.

The electrical connector according to the present invention is further described with reference to the accompanying drawings and the specific embodiments.

The present invention is more particularly described in the following examples that are intended as illustrative only since numerous modifications and variations therein will be apparent to those skilled in the art. Various embodiments of the invention are now described in detail. Referring to the drawings, FIGS. 5-12, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, the terms "comprising," "including," "having," "containing," "involving," and the like are to be understood to be open-ended, i.e., to mean including but not limited to.

A list of reference numerals with corresponding components as shown in the drawings is given below only for the purpose of a reader's convenience:

LIST OF REFERENCE NUMERALS IN FIGS. 1-4

Insulating body 502
Receiving slot 5021
Conductive terminal 504
Main portion 5041
First abutting segment 5042
Second abutting segment 5043
Solder ball 506
Insulating body 602
Receiving slot 6021
Conductive terminal 604
Base 6041
Material belt connecting portion 6042
Retaining arm 6043

List of Reference Numerals in the electrical connector according to one or more embodiments of the present invention, FIGS. 5-12:

Insulating body 1
Top surface 11
Bottom surface 12
Receiving slot 13
First side wall 131
Second side wall 132
Third side wall 133
Fourth side wall 134
Reserved space 136
Displacement space 137
Stop block 138
Limiting portion 1381
Stopping portion 1382
Reserved slot 139
Terminal 2
Base 21
Fixing portion 211
Contact arm 22
Retaining slot 221
First abutting segments 23
Second abutting segments 24
Material belt connecting portion 25
Solder ball 3
Gap 4

Figure 5:
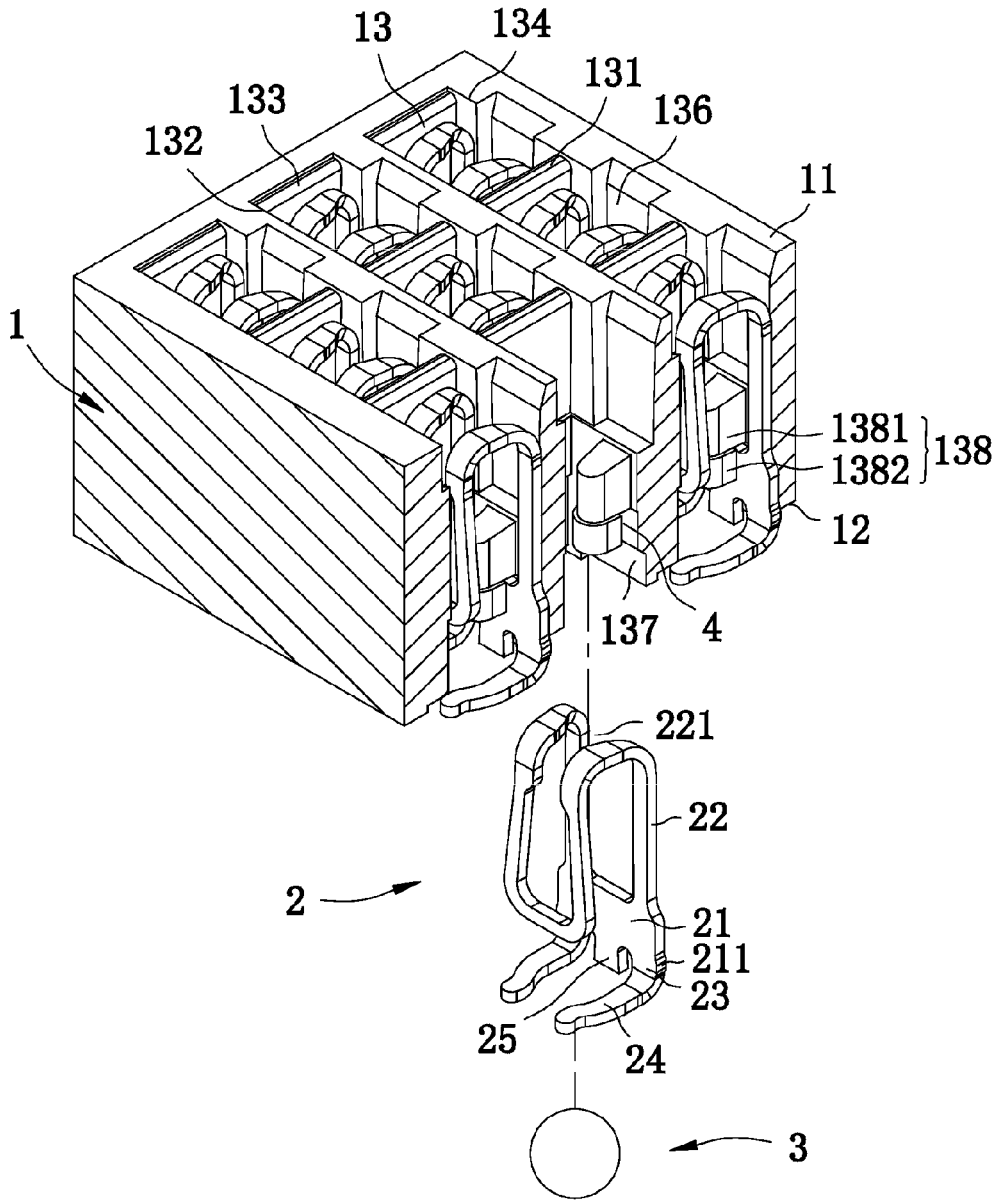
FIG. 5 is an exploded view of an electrical connector according to a first embodiment of the present invention.
Figure 6:
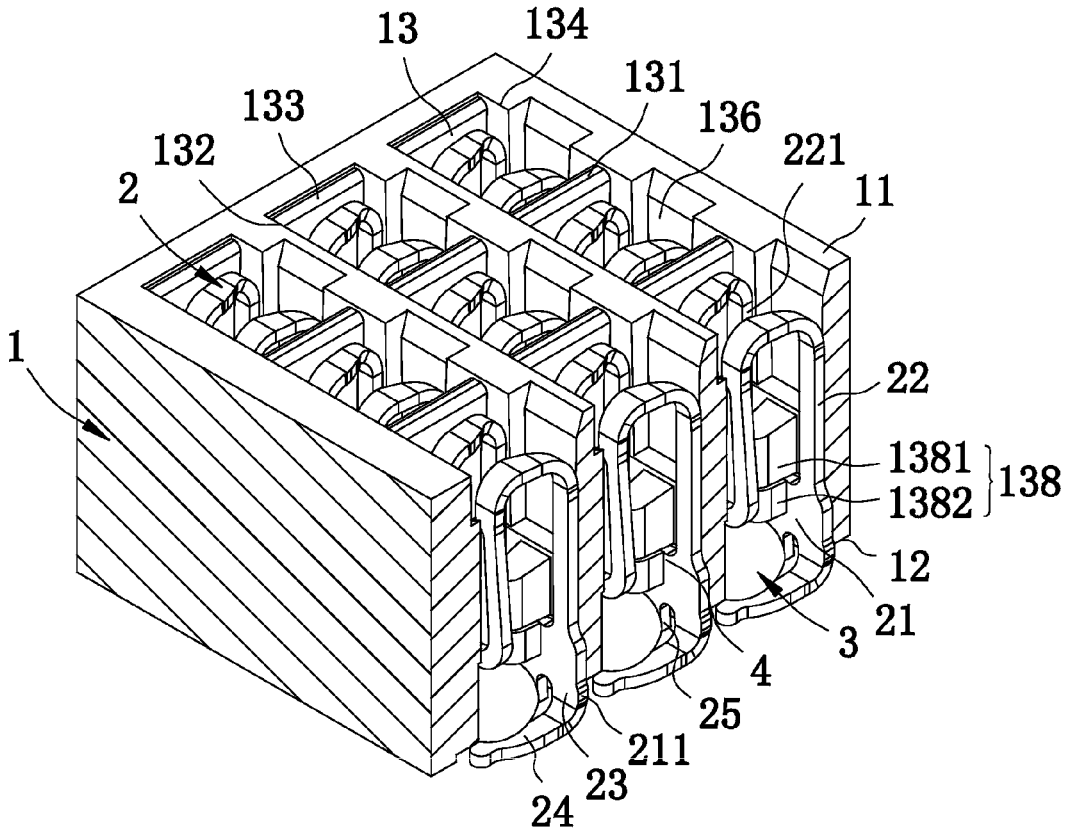
FIG. 6 is a constitutional view of the electrical connector according to the first embodiment of the present invention.
Figure 7:
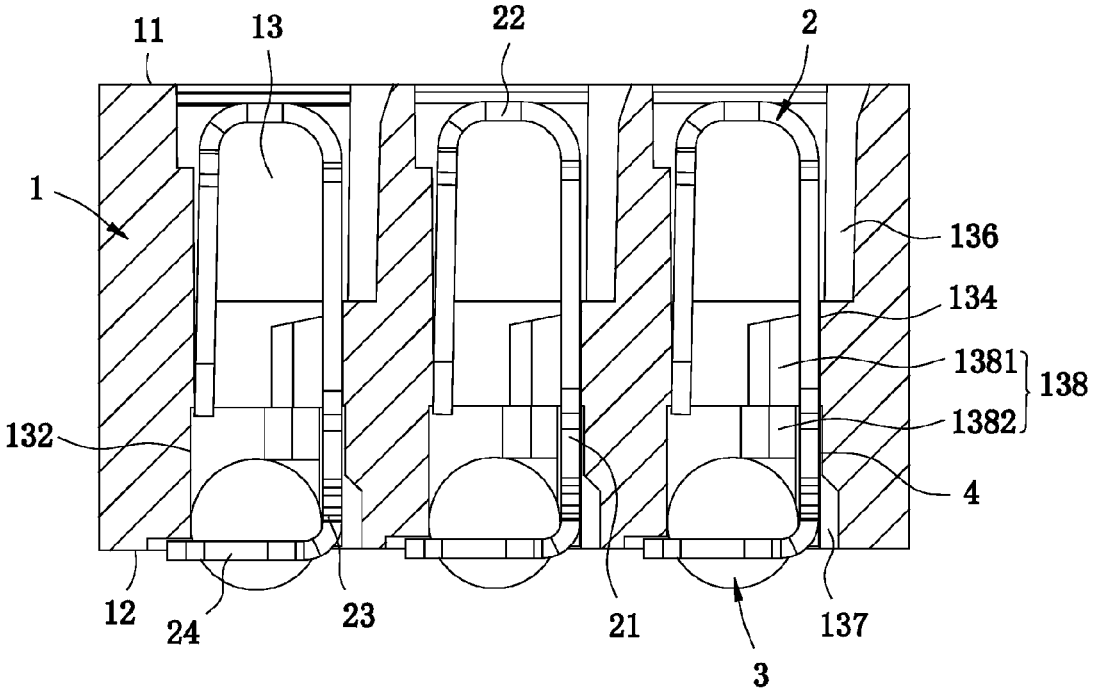
FIG. 7 is a front view of the electrical connector according to the first embodiment of the present invention.

Referring to FIGS. 5-7, the electrical connector according to one embodiment of the present invention, which can be used for electrically connecting a chip module (not shown) to a circuit board (not shown), includes an insulating body 1, a plurality of terminals 2 disposed on the insulating body 1, and a plurality of solder balls 3 in the same number as the terminals 2.

Referring to FIGS. 5-7, the insulating body 1 has a top surface 11, a bottom surface 12, and a plurality of receiving slots 13 formed through the top surface 11 and the bottom surface 12.

Each of the receiving slots 13 has a first side wall 131, a second side wall 132, a third side wall 133, and a fourth side wall 134. The first side wall 131 is disposed opposite to the third side wall 133, and the second side wall 132 is disposed opposite to the fourth side wall 134. At the joint with the fourth side wall 134, the first side wall 131 is recessed with a fixing slot (not labeled), in which the fixing slot is located on a lower end of the first side wall 131 and is formed through the bottom surface 12. The bottom of the second side wall 132 is partially recessed upwards to form a recessed portion (not labeled), in which a top wall of the recessed portion forms the highest part of the bottom surface 12 of the insulating body 1. The third side wall 133 has the same construction as the first side wall 131 and similarly has a fixing slot (not labeled). The fourth side wall 134 is recessed with a reserved space 136 to provide an entrance for the insertion of a pin of the chip module. The fourth side wall 134 is recessed with a displacement space 137, in which the displacement space 137 is formed through the bottom surface 12 and provides a space for elastic deformation of the terminal 2. The fourth side wall 134 is provided with a stop block 138 between the reserved space 136 and the displacement space 137. The stop block 138 is roughly in a shape of "[" and includes a limiting portion 1381 connected to the fourth side wall 134 and a stopping portion 1382 connected to a lower end of the limiting portion 1381. A gap 4 is formed between the stopping portion 1382 and the fourth side wall 134, in which the gap 4 is wide enough for receiving the width of the terminal 2 in the thickness direction. The bottom wall of the stopping portion 1382 is used for stopping the solder ball 3 from moving upwards so that when the solder ball 3 is riveted and pressed on the terminal 2, the solder ball 3 is located at the same height as other solder balls relative to the circuit board, thereby ensuring the soldering between the electrical connector and the circuit board and further ensuring the electrical conduction between the electrical connector and the circuit board.

Referring to FIGS. 5-7, each of the terminals 2 is formed by punching a metal sheet and has a base 21, two contact arms 22 extending firstly upwards and then downwards from the base 21, two first abutting segments 23 extending downwards from the base 21, and two second abutting segments 24 extending forwards from the two first abutting segments 23.

The two first abutting segments 23 extend downwards from the base 21 and the two second abutting segments 24 extend forwards from the two first abutting segments 23. Thus the expanded area of the terminal 2 is reduced, so that few waste material during the stamping, the cutting and the molding of the terminal 2 is generated, thereby saving the material.

Two sides of the base 21 are respectively provided with a fixing portion 211. The fixing portion 211 combines with the fixing slot (not labeled) in the receiving slot 13 to fix the terminal 2 in the receiving slot 13. The base 21 is located in the gap 4 and is stopped by the limiting portion 1381 from excessively moving upwards.

A retaining slot 221 is formed between the two contact arms 22 and is used for retaining the pin, so that the chip module is conducted with the circuit board. Ends of the two contact arms 22 are connected so as to retain the pin more firmly.

The two second abutting segments 24 are symmetrically disposed and get close to each other during the extension. The two second abutting segments 24 are exposed from the receiving slots 13 and abut against the bottom surface 12 (that is, the bottom of the second side wall 132) so as to stop the two second abutting segments 24 from excessively moving upwards, thereby effectively protecting the terminal 2 and ensuring the life of the terminal 2. The width between the two second abutting segments 24 is smaller than the diameter of the solder ball 3, and the two second abutting segments retain the solder ball 3 with the cutting surfaces thereof.

The terminal 2 further has a material belt connecting portion 25 extending downwards from the base 21, in which the material belt connecting portion 25 is located between the two first abutting segments 23.

Referring to FIG. 7, each of the solder balls 3 are received in a lower end of each receiving slot 13 respectively. The solder ball 3 has the periphery below the horizontal center line supported by the two second abutting segments 24 and can move between the two second abutting segments 24 and the stopping portion 1382. The solder ball 3 abuts against the bottom wall of the stopping portion 1382 of the stop block 138 in the receiving slot 13 where the solder ball 3 locates. Alternatively, in other embodiments, the two second abutting segments 24 can retain the periphery below the horizontal center line of the solder ball 3 in a retaining manner.

During the assembling, referring to FIGS. 5-7, firstly each terminal 2 is disposed in the receiving slot 13 from the bottom surface 12 towards the top surface 11, so that the base 21 is located in the gap 4. The fixing portion 211 is fixed in the fixing slot (not labeled), the two contact arms 22 are located at the upper end of the receiving slot 13, such that the two first abutting segments 23 are located on one side of the displacement space 137, and the ends of the two second abutting segments 24 are located below the bottom of the second side wall 132.

Then, each solder ball 3 is disposed in the receiving slot 13 from the bottom surface 12 to the top surface 11, so that the periphery below the horizontal center line of the solder ball 3 is supported by the two second abutting segments 24, and the upper end of the solder ball 3 abuts against the bottom wall of the stopping portion 1382.

When the electrical connector is disposed on the circuit board, the electrical connector is fixedly connected to the circuit board by melting the solder ball 3. As the two second abutting segments 24 support the periphery below the horizontal center line of the solder ball 3, the melted solder paste falls partially on the surface of the second abutting segments 24 as a result of the stop of the second abutting segments 24, which can slow down the speed of the solder paste flowing towards the circuit board and relatively balance the solder paste on the terminal 2 and the circuit board, thereby ensuring the soldering effect between the terminal 2 and the circuit board, further ensuring the electrical conduction between the electrical connector and the circuit board, and meanwhile avoiding problems such as missing solder or false soldering.

Figure 8:
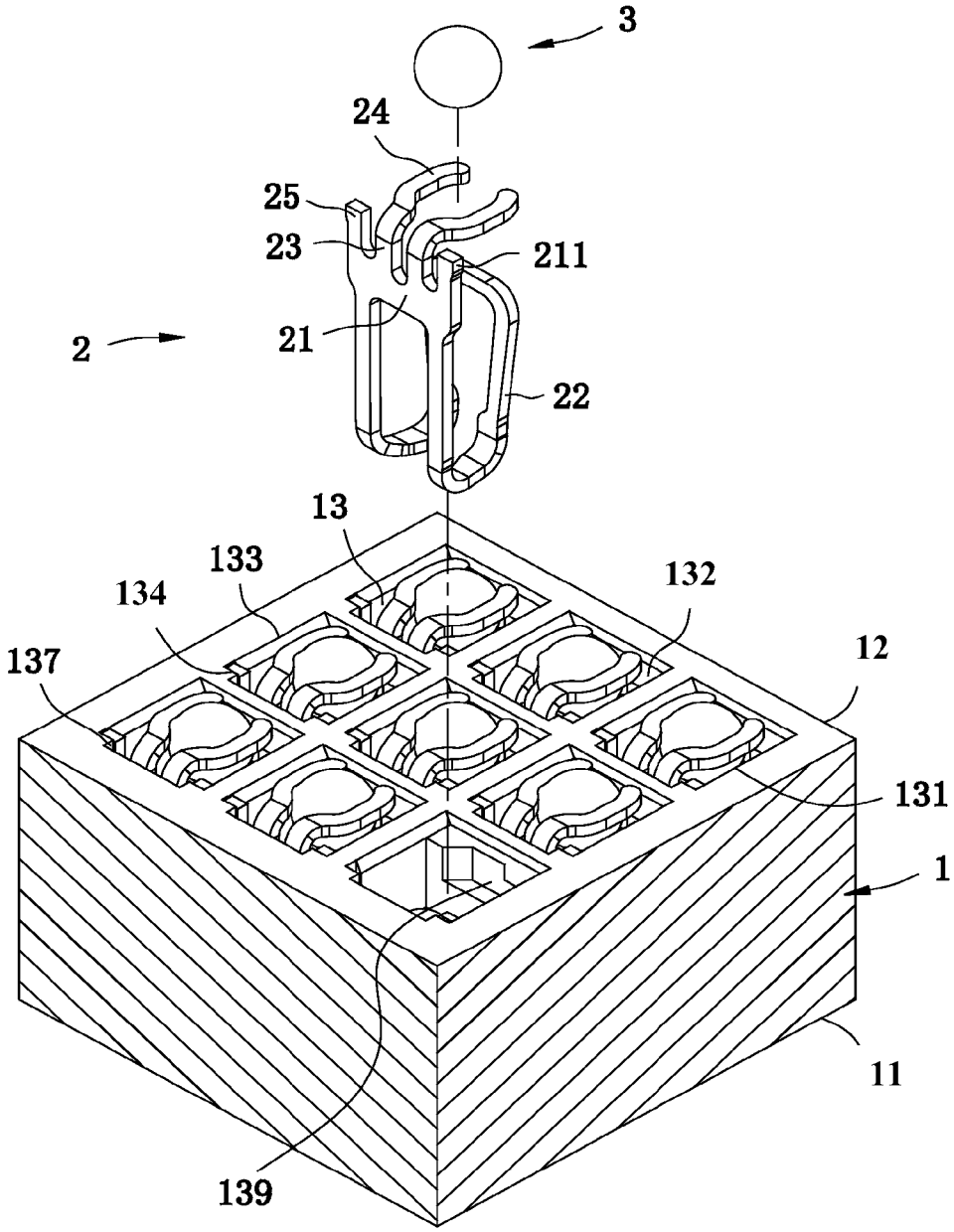
FIG. 8 is an exploded view of an electrical connector according to a second embodiment of the present invention.
Figure 9:
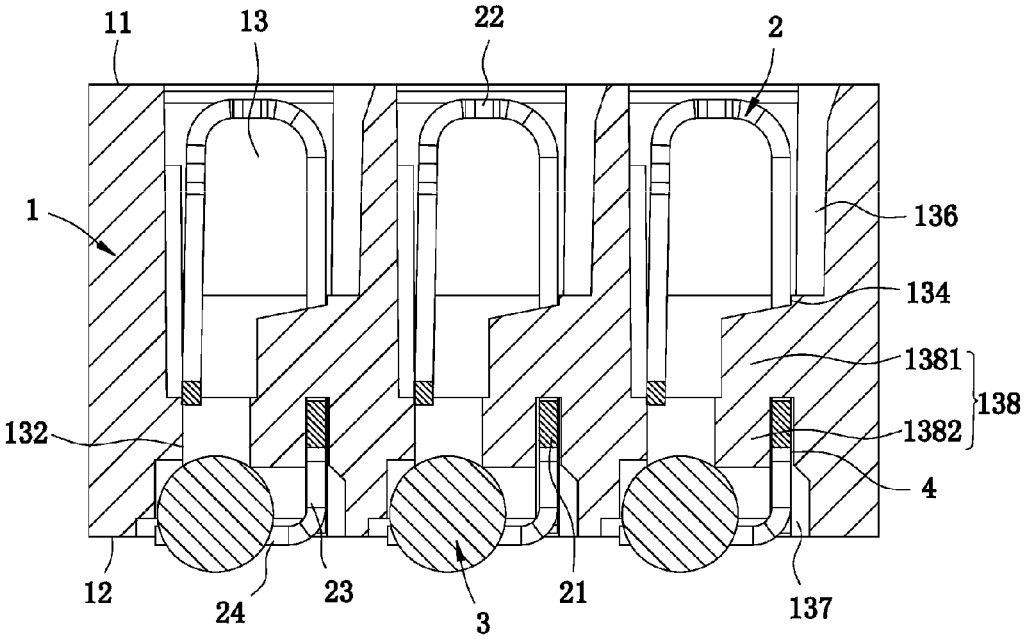
FIG. 9 is a sectional view of the electrical connector according to the second embodiment of the present invention.

FIGS. 8 and 9 illustrate a second embodiment of the electrical connector according to the present invention. Referring to FIGS. 8 and 9, the difference between the second embodiment and the first embodiment lies in that: the second side wall 132 is recessed with a reserved slot 139, in which the reserved slot 139 is located on the lower part of the receiving slot 13 and is formed through the bottom surface 12 of the insulating body 1. The reserved slot 139 is provided for receiving part of the solder ball 3. Two material belt connecting portions 25 are provided and are located on the two sides of the two first abutting segments 23. The embodiment can achieve the same effect as that of the first embodiment, and therefore, details are not repeated herein. The embodiment has one more effect as follows: as the two material belt connecting portions 25 are located on the two sides of the two first abutting segments 23, the two second abutting segments 24 get closer to each other, thereby being capable of retaining the solder ball 3 smaller than the normal size and beneficial to the high density thereof.

Figure 10:
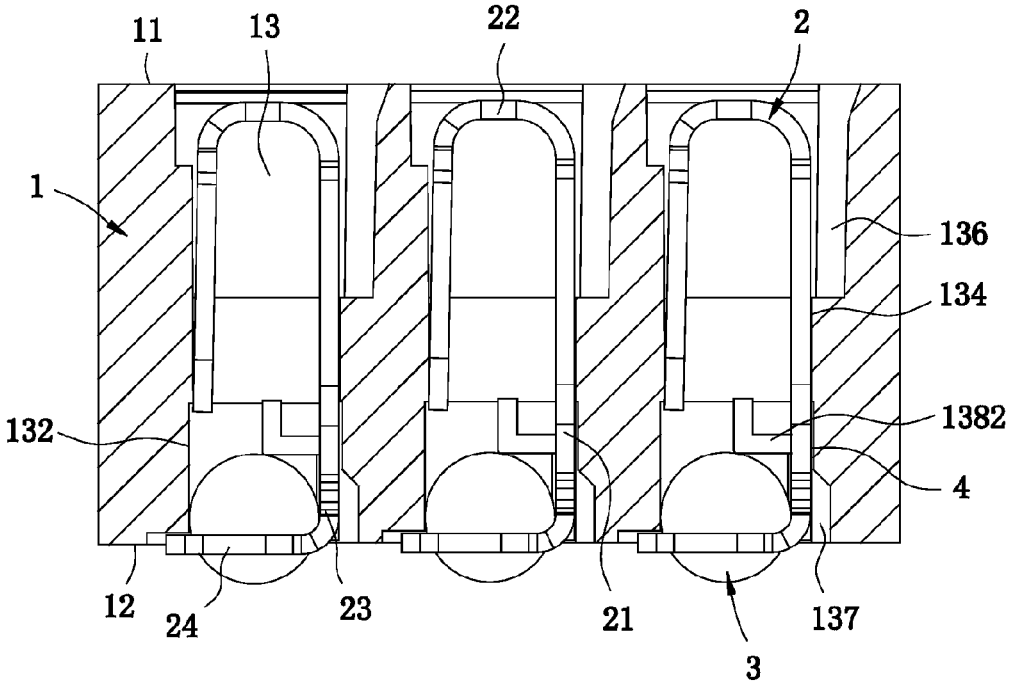
FIG. 10 is a sectional view of an electrical connector according to a third embodiment of the present invention.
Figure 11:
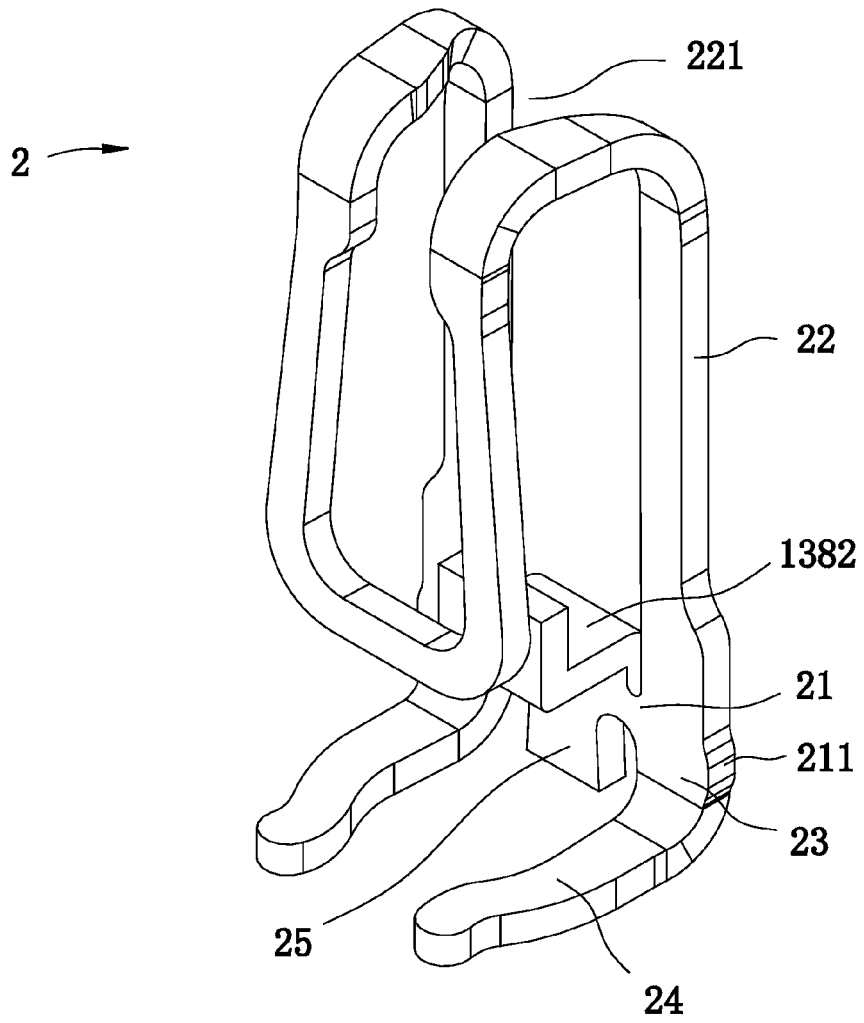
FIG. 11 is a schematic structural view of a terminal in the electrical connector according to the third embodiment of the present invention.
Figure 12:
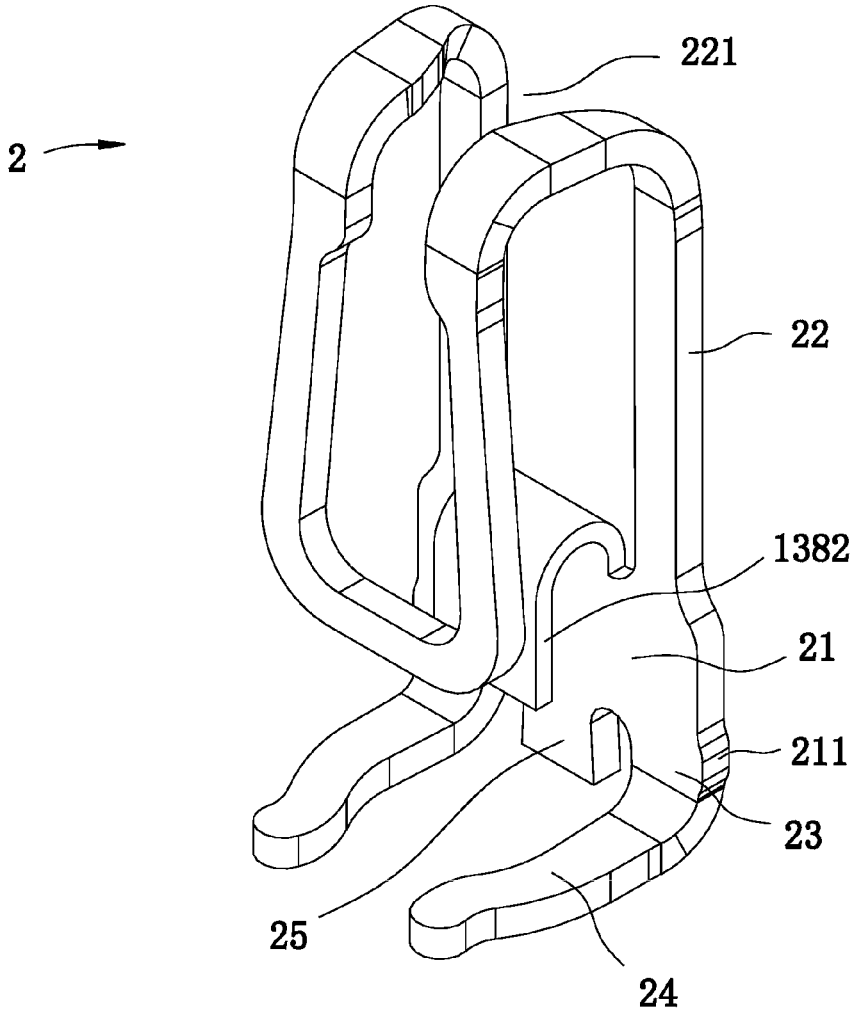
FIG. 12 is another schematic structural view of the terminal in the electrical connector according to the third embodiment of the present invention.

FIGS. 10-12 illustrate a third embodiment of the electrical connector according to the present invention. Referring to FIGS. 10-12, the difference between the third embodiment and the first embodiment lies in that: the stop block 138 extends from the base 21 of the terminal 2 towards the second abutting segments 24, and the stop block 138 is only provided with the stopping portion 1382. The embodiment can achieve the same effect as that of the first embodiment, and therefore, details are not repeated herein.

Accordingly, among other things, the electrical connector of the present invention has the following advantages.

1. As the base is extended downwards to form the two first abutting segments and the two first abutting segments are extended forwards to form the two second abutting segments, the expanded area of the terminal is reduced, thereby saving the material.

2. The two second abutting segments are exposed from the receiving slots and abut against the bottom surface of the insulating body. When the solder ball is riveted and pressed between the two second abutting segments, the two second abutting segments cannot excessively move upwards with the bottom surface of the insulating body as a support, thereby effectively protecting the terminal and ensuring the life of the terminal.

3. The stop block is disposed in the receiving slot of the insulating body and abuts against the solder ball. When the solder ball is riveted and pressed between the two second abutting segments, the two second abutting segments support the solder ball on a pre-determined position, and the solder ball is located at the same height as the other solder balls relative to the circuit board, thereby ensuring the soldering between the electrical connector and the circuit board and further ensuring the electrical conduction between the electrical connector and the circuit board.

4. During the soldering, since the two second abutting segments are located on the periphery below the horizontal center line of the solder ball, the melted solder paste falls partially on the surface of the second abutting segments as a result of the stop of the second abutting segments, which can slow down the speed of the solder paste flowing to the circuit board and relatively balances the solder paste on the terminal and the circuit board, thereby ensuring the soldering effect between the terminal and the circuit board, further ensuring the electrical conduction between the electrical connector and the circuit board and meanwhile avoiding problems such as missing solder or false soldering.

5. As the two material belt connecting portions are located on the two sides of the two first abutting segments, the two second abutting segments get closer to each other, thereby being capable of supporting the solder ball smaller than a normal size and beneficial to the high density thereof.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, having a plurality of receiving slots formed through the insulating body;

a plurality of terminals, received in the receiving slots respectively, wherein the terminal has a base fixed in the receiving slot, two first abutting segments extending downwards from the base, and two second abutting segments extending forwards from the two first abutting segments, the two second abutting segments are exposed from the receiving slots and abut against a bottom surface of the insulating body so as to limit the upward movement thereof, and a width between the two second abutting segments is smaller than a diameter of a solder ball;

a plurality of stop blocks, correspondingly disposed in the receiving slots respectively; and a plurality of solder balls, disposed in the receiving slots respectively, wherein the two second abutting segments are located on the periphery below a horizontal center line of the solder ball, and the solder ball is located below a bottom surface of the stop block in the receiving slot so as to limit the upward movement thereof.

2. The electrical connector according to claim 1, wherein the two second abutting segments are symmetrically disposed.

3. The electrical connector according to claim 1, wherein the two second abutting segments gradually get close to each other during the extension.

4. The electrical connector according to claim 1, wherein a side wall of the insulating body used for abutting against the two second abutting segments is recessed upwards to form a recessed portion, ends of the two second abutting segments enter the recessed portion and abut against a top wall of the recessed portion.

5. The electrical connector according to claim 1, wherein the stop blocks each comprise a limiting portion connected to a side wall thereon and a stopping portion connected to a lower end of the limiting portion, a gap is formed between the stopping portion and the side wall thereon, and the gap is used for receiving the base of the terminal.

6. The electrical connector according to claim 1, wherein a reserved slot is recessed in the side wall of the receiving slot disposed with the stop block, the reserved slot abuts against a lower part of the receiving slot and is formed through the bottom surface of the insulating body.

7. The electrical connector according to claim 1, wherein the base is extended downwards to form a material belt connecting portion, and the material belt connecting portion is located between the two first abutting segments.

8. The electrical connector according to claim 1, wherein the base is extended downwards to form two material belt connecting portions, and the material belt connecting portions are located on two sides of the two first abutting segments.

9. The electrical connector according to claim 1, wherein the two second abutting segments retain the solder ball by using cutting surfaces thereof.

10. The electrical connector according to claim 1, wherein the stop blocks extend from the base towards the second abutting segments.

11. The electrical connector according to claim 1, wherein the solder ball is movable between the two second abutting segments and the stop blocks.

12. The electrical connector according to claim 1, wherein the base is extended upwards to form two contact arms, and a retaining slot is formed between the two contact arms.

13. The electrical connector according to claim 12, wherein the two contact arms are further extended downwards until ends thereof are connected to each other.

* * * * *